US007694422B2

(12) United States Patent
Vaes

(10) Patent No.: US 7,694,422 B2
(45) Date of Patent: Apr. 13, 2010

(54) UTILITY KNIFE

(76) Inventor: Ed Vaes, 463 Seaman Street, Stoney Creek (CA) L8E 2R2

( * ) Notice: Subject to any disclaimer, the term of this patent is extended or adjusted under 35 U.S.C. 154(b) by 119 days.

(21) Appl. No.: 11/872,231

(22) Filed: Oct. 15, 2007

(65) Prior Publication Data

US 2008/0086891 A1 Apr. 17, 2008

Related U.S. Application Data

(60) Provisional application No. 60/829,687, filed on Oct. 17, 2006.

(51) Int. Cl.
*B26B 5/00* (2006.01)
*B26B 11/00* (2006.01)

(52) U.S. Cl. ..... 30/162; 30/292; 30/319; 30/347; 7/158; D8/51; D8/98; D8/99

(58) Field of Classification Search ..... 30/162, 30/319, 335, 125, 320, 329, 337, 292, 347, 30/351; 7/158, 103, 105; 81/488; 29/235; D8/98, 51, 99, 14, 107; 83/665, 676, 666
See application file for complete search history.

(56) References Cited

U.S. PATENT DOCUMENTS 1,574,819 A * 3/1926 Jezler ..... 30/286
2,978,807 A * 4/1961 Lurie ..... 30/2
2,994,899 A * 8/1961 Moilanen ..... 15/244.2
4,020,550 A * 5/1977 Okada ..... 30/124
4,910,821 A * 3/1990 Kieferle ..... 7/158
5,074,045 A * 12/1991 Brookfield ..... 30/172
5,495,670 A * 3/1996 Quinn ..... 30/162
5,504,998 A * 4/1996 Nguyen ..... 30/319
5,569,285 A * 10/1996 Webb ..... 606/180
6,065,215 A * 5/2000 Arai ..... 30/319
D439,128 S * 3/2001 Wass ..... D8/98
D439,491 S * 3/2001 Falt ..... D8/98
D441,631 S * 5/2001 Carroll ..... D8/98
6,321,454 B1 * 11/2001 Wass ..... 30/294
D510,693 S * 10/2005 Vaes ..... D8/99
7,032,315 B1 * 4/2006 Busse ..... 30/153
2003/0159297 A1 * 8/2003 Chae ..... 30/347

* cited by examiner

*Primary Examiner*—Ghassem Alie

(57) ABSTRACT

A knife which has a body with a blade head at one end and roller at the other end. The blade head also has a planar first guide cheek and planar second guide cheek. positioned at an angle, alpha relative to the blade which is received between the first and second guide cheeks. The knife also has a device for urging the blade between a retracted position and an extended position. The roller is made of a right wheel half and a left wheel half such that the roller made of two halves in intimate contact with each other.

2 Claims, 12 Drawing Sheets

FIG. 18
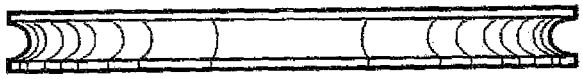
FIG. 19
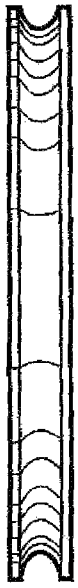
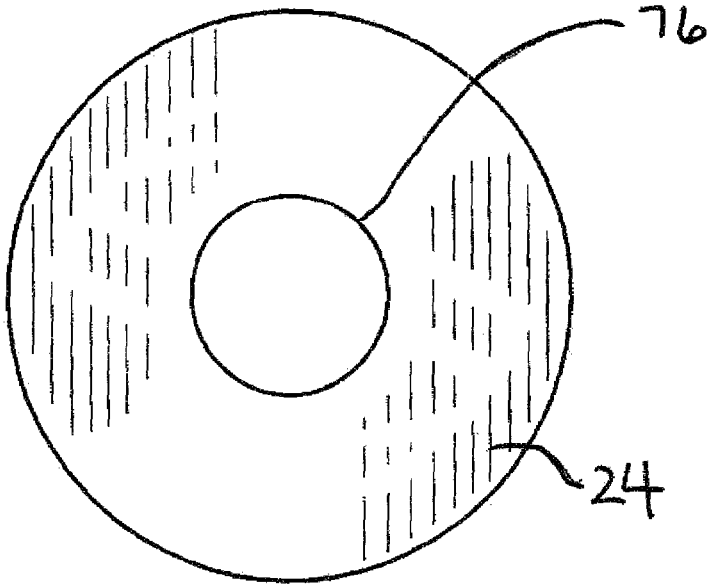
FIG. 20
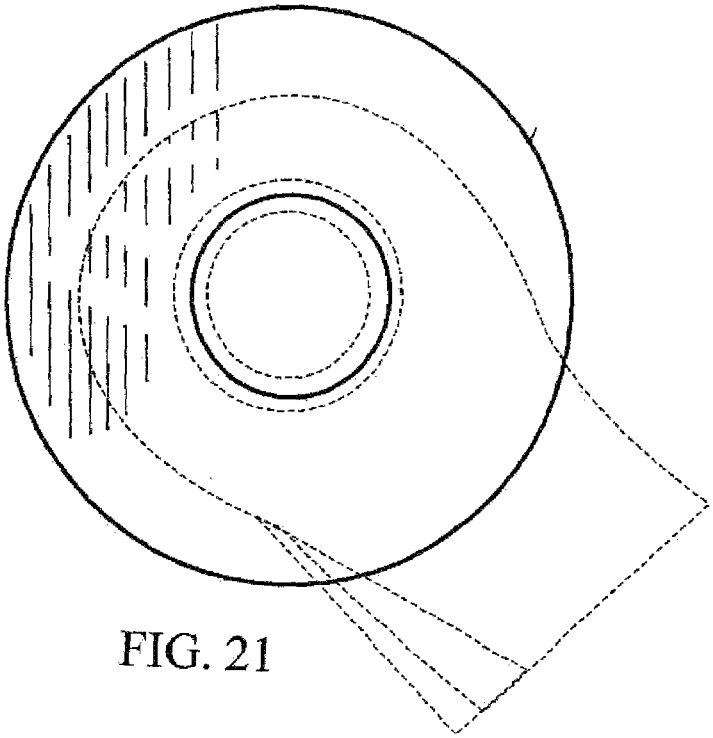
FIG. 21

FIG. 22
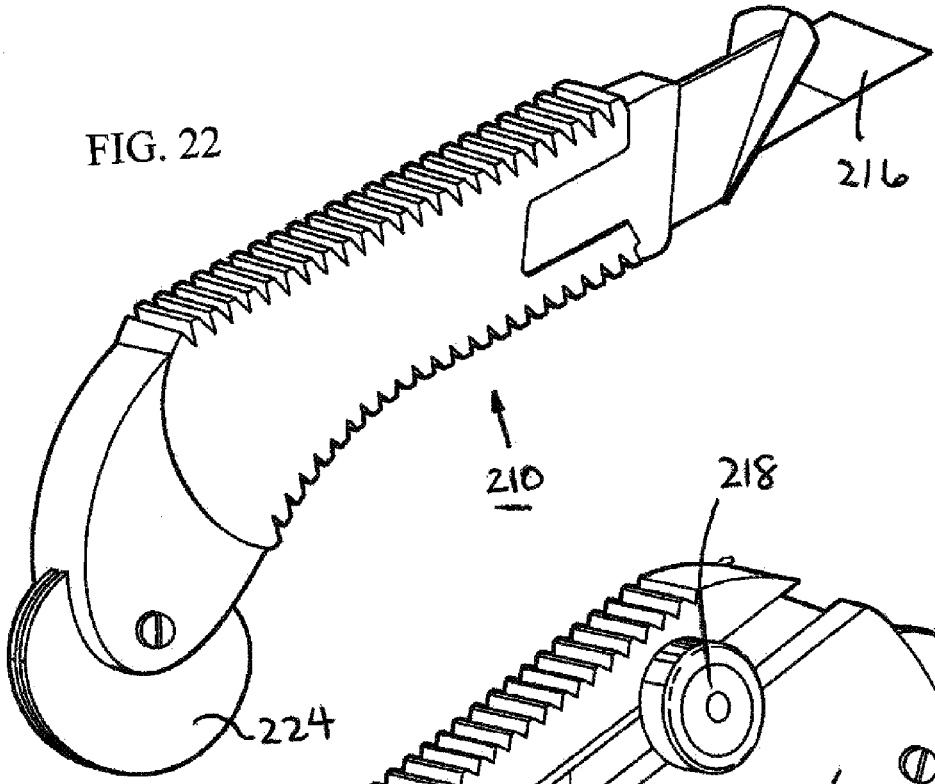
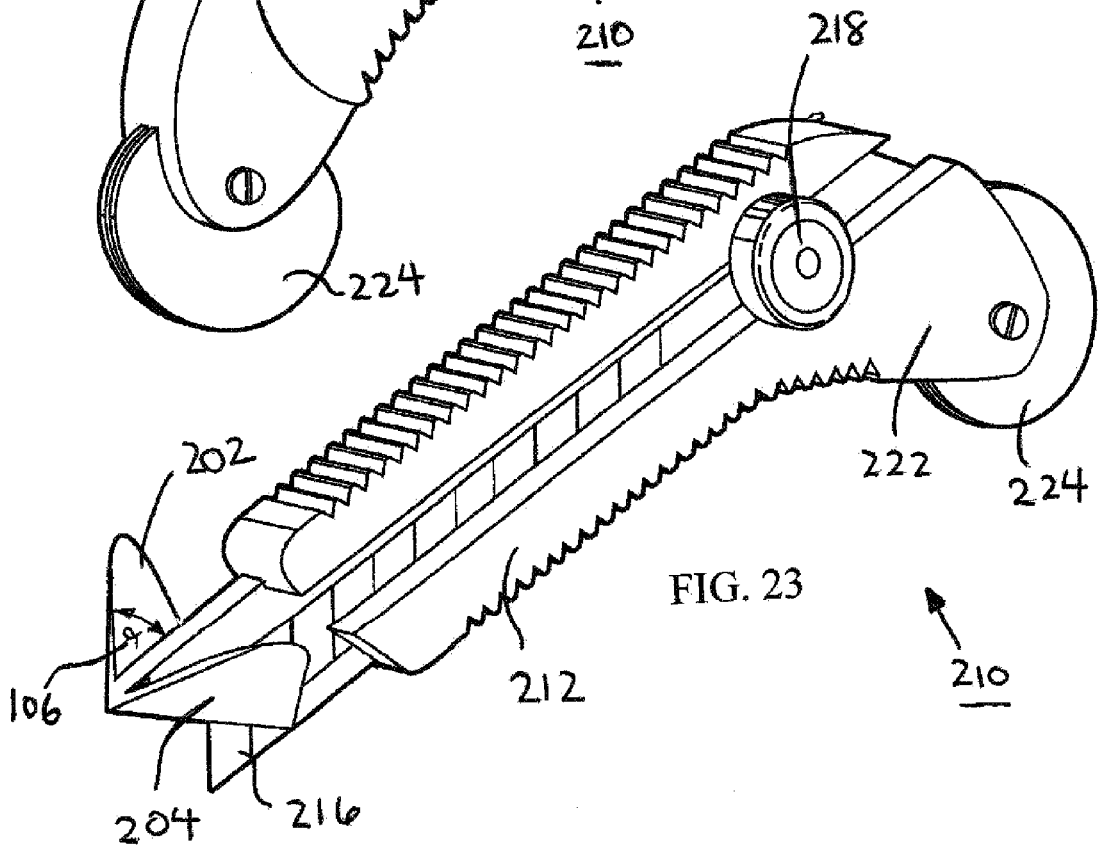
FIG. 23

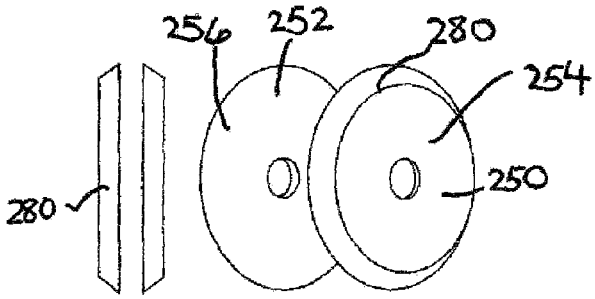
FIG. 26
FIG. 27
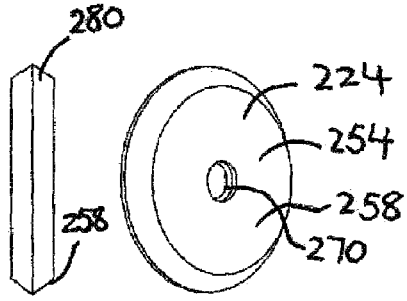
FIG. 28
FIG. - 29
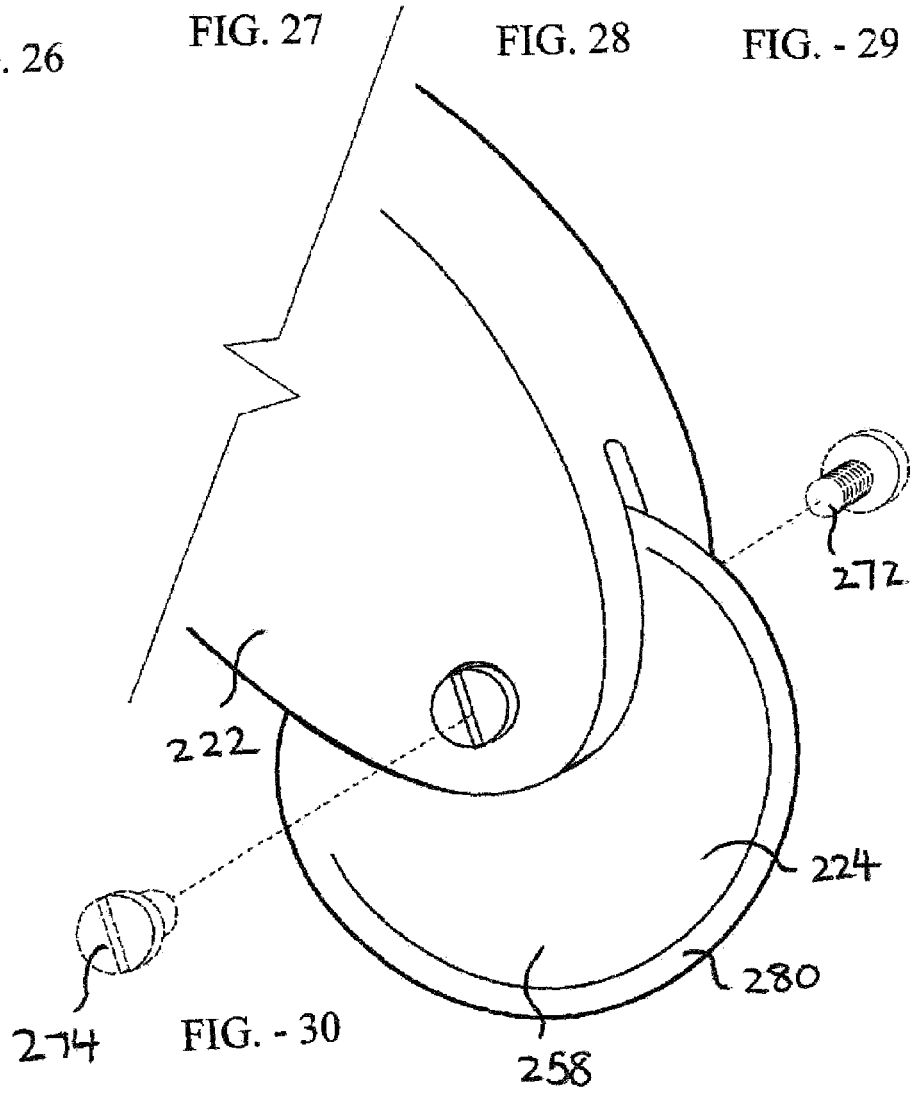
FIG. - 30

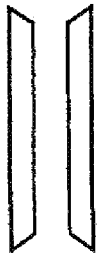
FIG. - 31
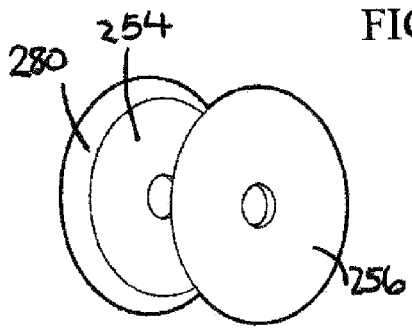
FIG. - 32
FIG. - 33
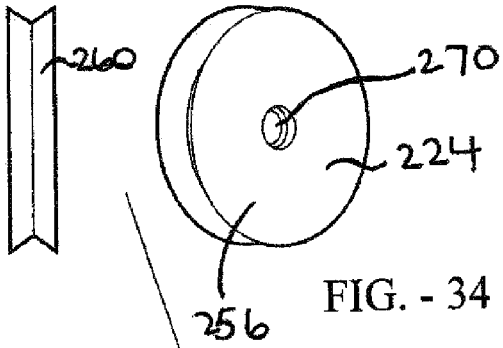
FIG. - 34
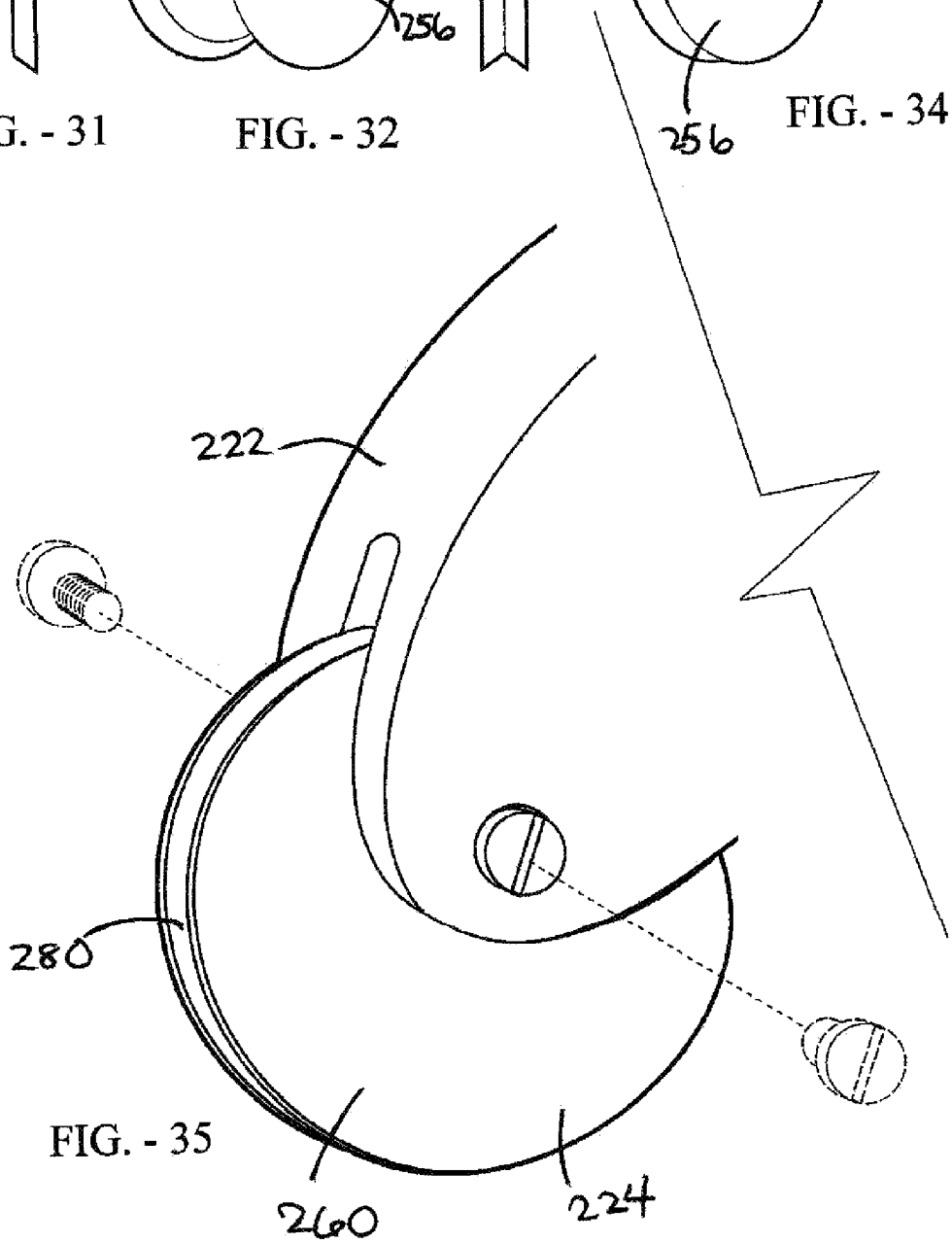
FIG. - 35

UTILITY KNIFE

FIELD OF THE INVENTION

The present invention claims priority from regularly filed U.S. provisional application No. 60/829,687 filed Oct. 17, 2006 by Ed Vaes under the title Utility Knife. The present invention relates to knives, in particular relates to a utility knife having a retractable blade and replaceable roller.

BACKGROUND OF THE INVENTION

The present invention is related to the Utility Knife described and patented under U.S. Pat. No. 6,3271,454 issued Nov. 27, 2001 under the title Utility Knife and that patent specification is incorporated herein for reference.

BRIEF DESCRIPTION OF THE DRAWINGS

The invention will now be described by way of example only with reference to the following Figures in which.

FIG. 18 is an end plan view of the roller.

FIG. 19 is an end plan view of the roller.

FIG. 20 is a side plan view of the roller.

FIG. 21 is a side plan view of the roller showing it diploid in the roller end of the knife in dotted lines.

FIG. 22 is a rear right side perspective view of an alternate embodiment, namely knife 210.

FIG. 23 is an upright left side perspective view of the alternate embodiment, namely knife 210 shown in FIG. 22.

FIG. 26 is an end plan view of left wheel half 252 and right wheel half 250 in the unassembled position.

FIG. 27 is a perspective unassembled view of left wheel half 252 and right wheel half 250.

FIG. 28 is an assembled elevational view of left wheel half 252 and right wheel half 250 in the pointed position 258.

FIG. 29 is a perspective view of the roller 224 in the pointed positioned 258.

FIG. 30 is a partial cut away perspective view of the roller end showing roller 222 In the pointed position assembled onto the end of knife 210.

FIG. 31 is an elevational view of left wheel half 252 and right wheel half 250 in the unassembled position.

FIG. 32 is a perspective view of left wheel half 252 and right wheel half 250 in the unassembled position.

FIG. 33 is an elevational view of left wheel half 252 and right wheel half 250 in an assembled groove position 260.

FIG. 34 is a perspective view of wheel 222 in a groove position.

FIG. 35 is a partial cut away perspective view of the roller and knife with the roller in the grooved position shown assembled onto the roller end of the knife.

DETAILED DESCRIPTION OF THE PREFERRED EMBODIMENT

Retracting Mechanism

Figure 1:
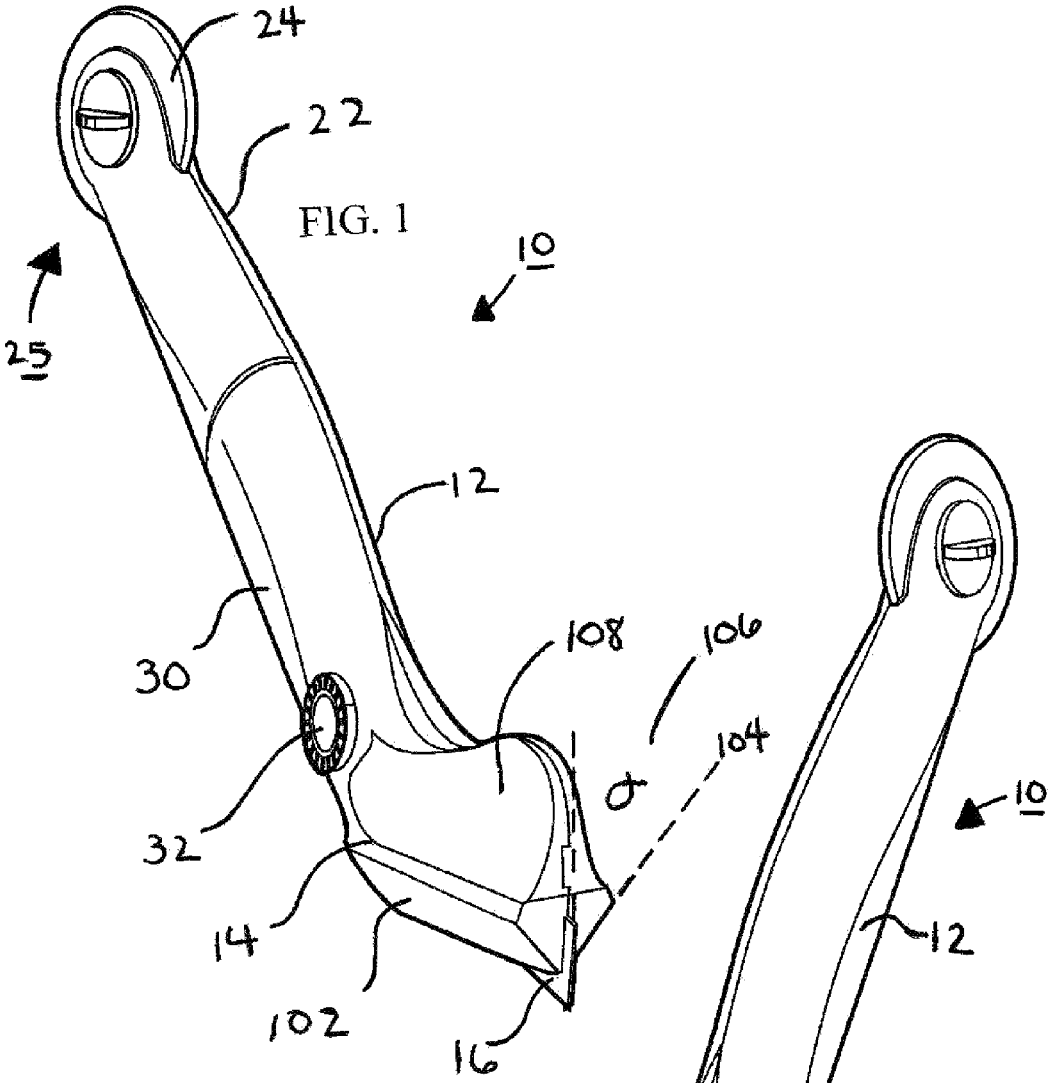
FIG. 1 is a left side perspective view of the knife.

The present invention a utility knife shown generally as 10 includes the following major components, body 12, blade end 14 containing blade 16, sliding retract button 18, guide aperture 20 and an opening hatch 30 with a thumb screw 32. Utility knife 10 also has a roller end 22 having a roller 24 and a roller attachment mechanism 25.

Referring now to FIGS. 5 through 11 which show details of the blade retraction mechanism. Blade retraction mechanism includes a splined back wall 44 which is integrally part of the back portion of the interior back portion of body 12 which has numerous parallel equally spaced splines along the back wall which has the guide aperture 20 running centrally bisecting the spline back wall 44 for receipt of the retract button 18. Blade 16 is housed in blade housing 46 with notches 49 having corresponding raised portions 51 defined in blade housing 46 for holding blade 16 in position in blade housing 46. The back side of blade housing 46 includes blade housing splines 47 not shown in FIG. 8 which cooperatively mesh with splines on spline back wall 44, thereby indexing blade housing 46 along the spline back wall 44 as retract button 18 is urged either forwardly or backwardly along guide aperture 20. By urging retract button 18 backwardly, the blade can be positioned in retracted position 48 and by urging retract button 18 forwardly, the bald can be extended to the extended position shown as 50.

Furthermore, extra blades 40 can be stored in blade storage compartment 42 which is exposed by opening thumb screw 32 and opening, opening hatch 30 to expose the storage compartment 42. Opening hatch 30 not only exposes blade storage compartment, but also exposes the blade retract mechanism and allows one to replace cutting blade 16 in the forward portion of the knife.

Figure 2:
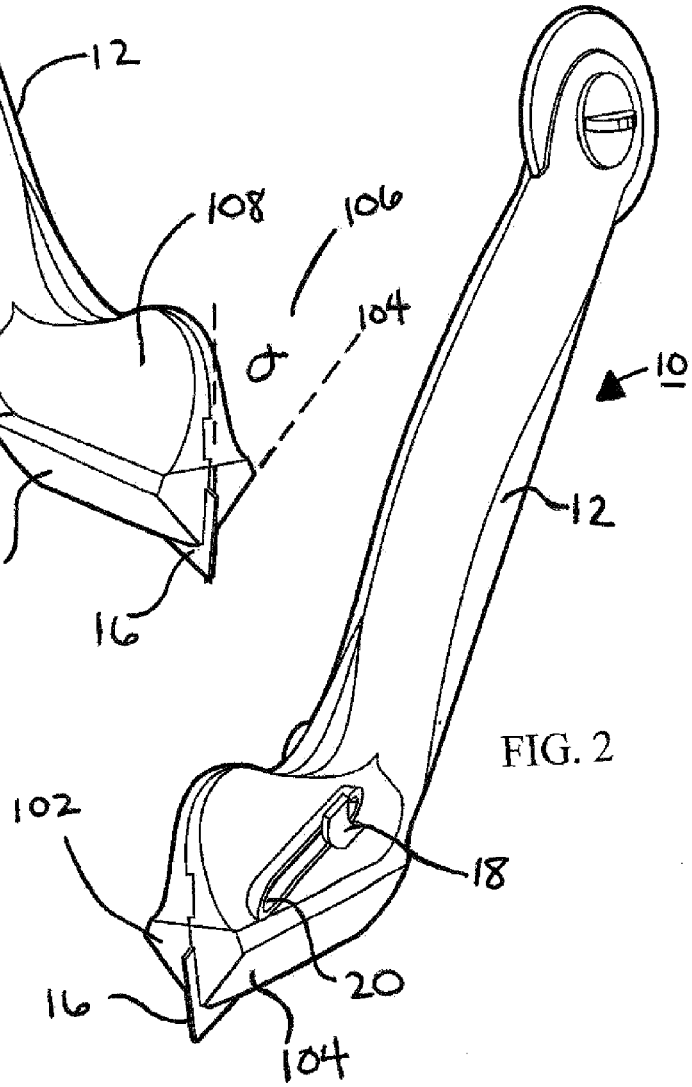
FIG. 2 is a right side perspective view of the knife.
Figure 3:
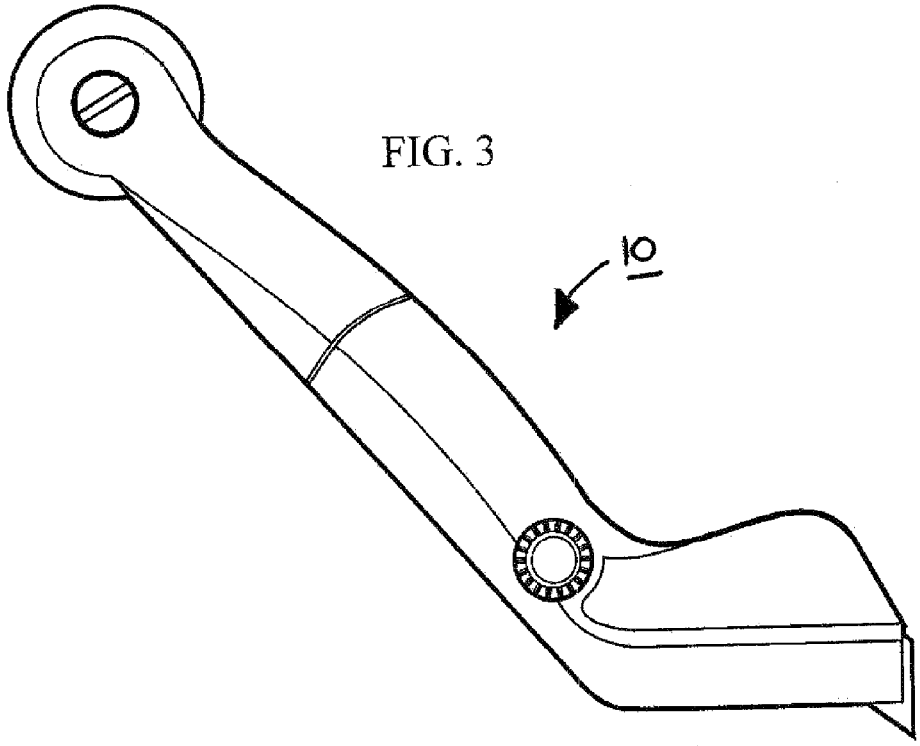
FIG. 3 is the left side plan elevational view of the knife.
Figure 4:
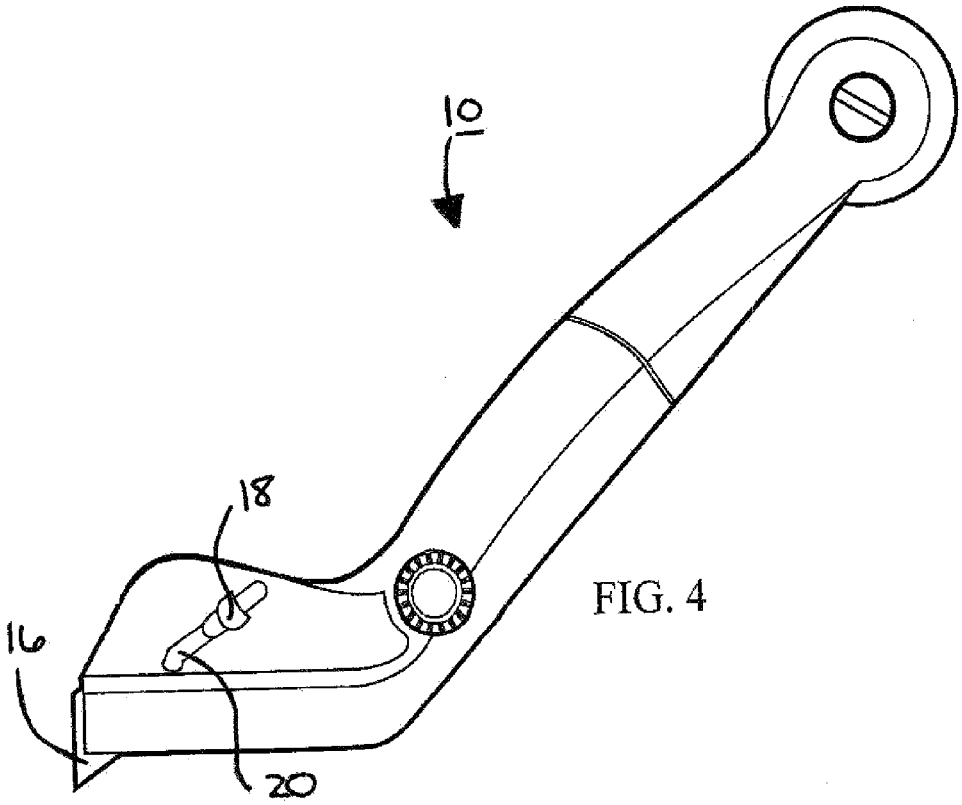
FIG. 4 is a right side plan elevational view of the knife.
Figures 5, 6, 7:
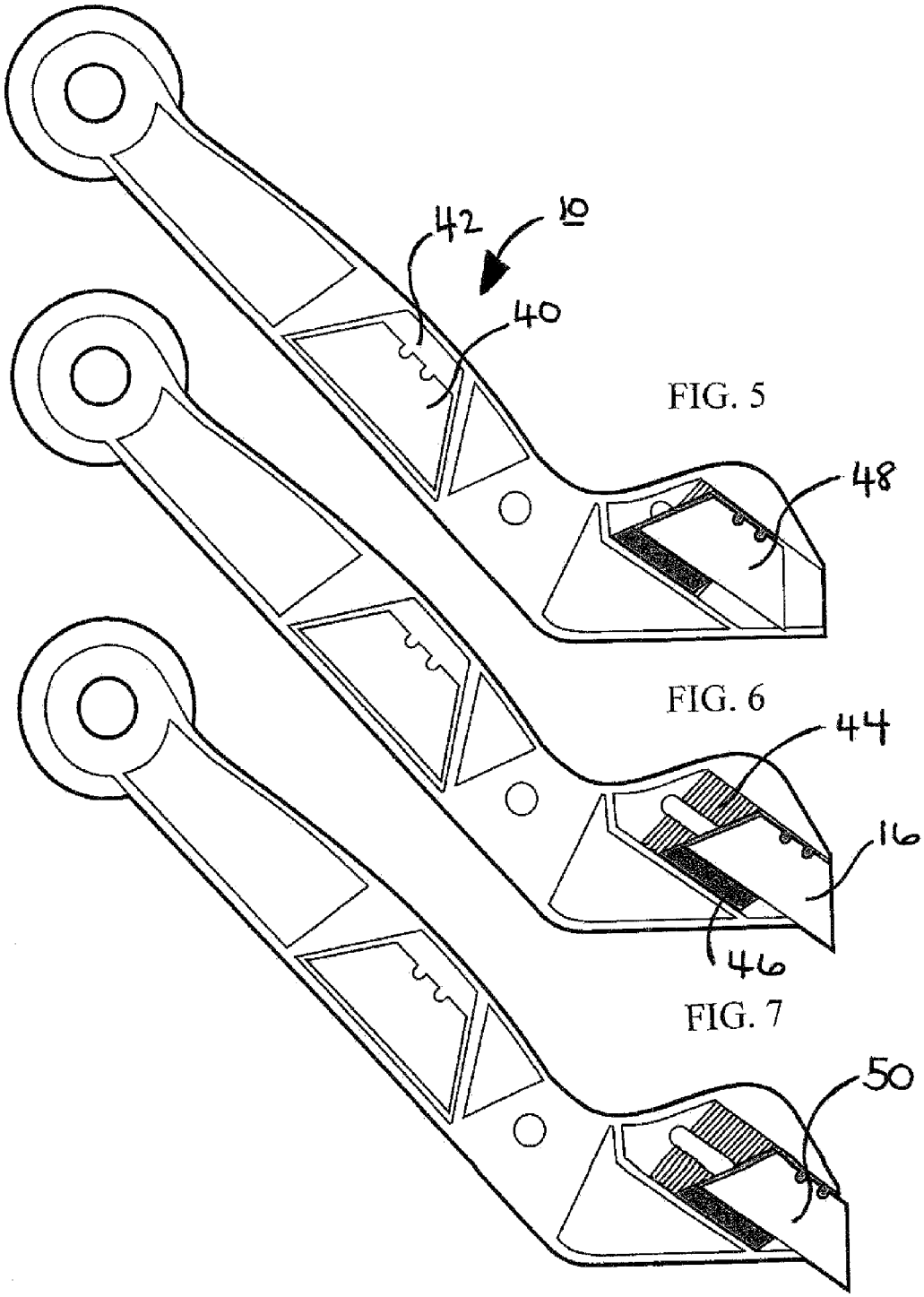
FIG. 5 is a cut away plan view of the knife showing the internal mechanism for the blade retraction system as well as the blade storage compartments with the blade in retracted position.
FIG. 6 is a cut away plan view of the knife showing the internal mechanism for the blade retraction system as well as the blade storage compartments with the blade in the semi-extended position.
FIG. 7 is a cut away plan view of the knife showing the internal mechanism for the blade retraction system as well as the blade storage compartments with the blade in the extended position.
Figures 8, 9, 10, 11:
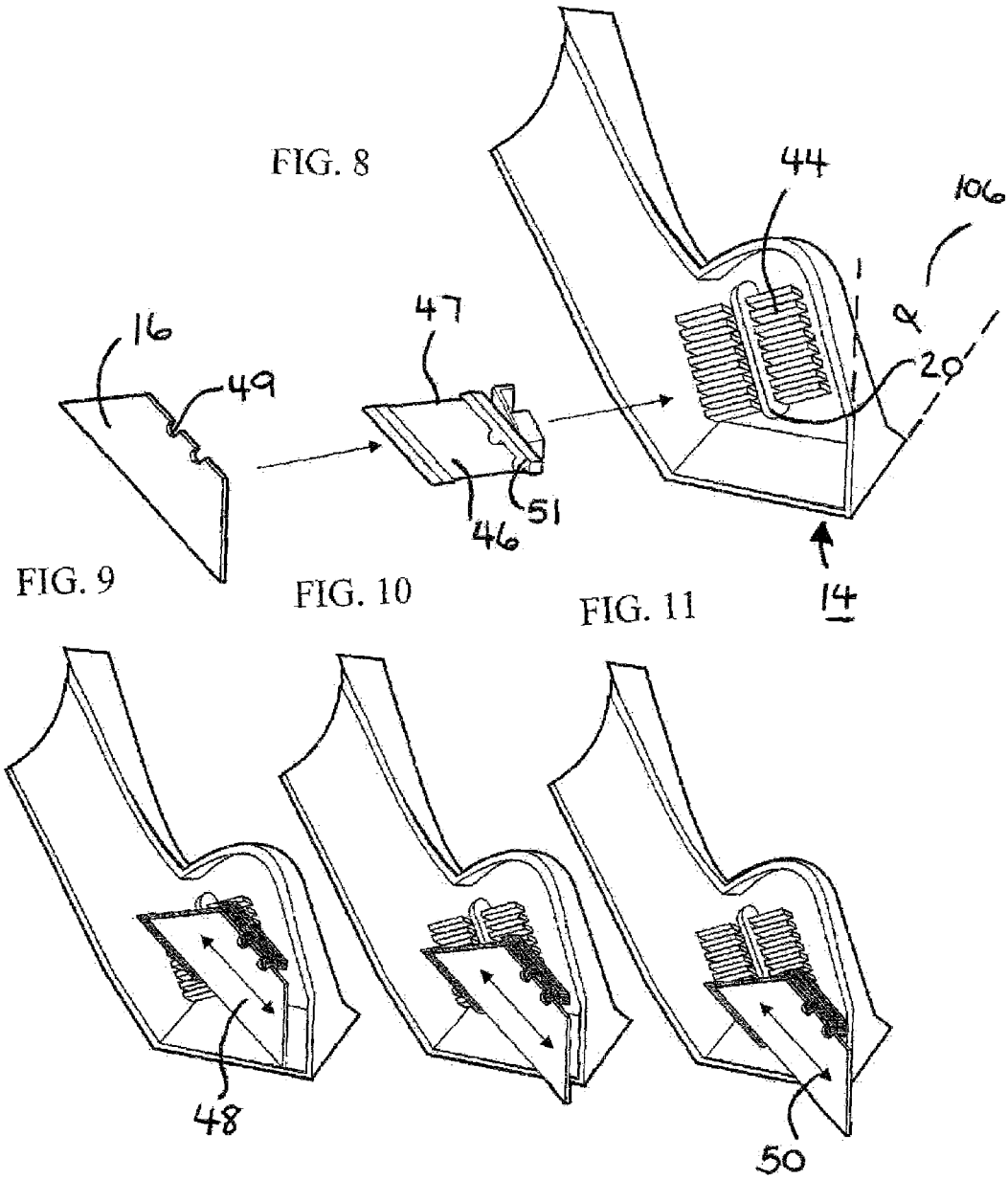
FIG. 8 is an exploded assembly cut away perspective view of the blade and the knife showing the assembly of the blade with the blade housing together with a portion of the blade end.
FIG. 9 is a cut away perspective view of the blade end with the blade in the retracted position.
FIG. 10 is a cut away perspective view of the blade end with the blade in the semi-retracted position.
FIG. 11 is a cut away perspective view of the blade end with the blade in the extended position.

Referring now to FIGS. 1 and 23 respectively, knife 10 and knife 210 includes a first guide cheek 102 and 202 respectively and second guide cheek 104 and 204 respectively which are planar guide cheeks, wherein the plane of the guide cheek is positioned at an angle alpha 106 relative to the plane of the blade 16 and 216 respectively. In other words, blade 16 is sandwiched between the two guide cheeks, namely first guide cheek 102 and second guide cheek 104, wherein the plane of each guide cheek is angled at a angle alpha 106 relative to the vertical plane of the blade as shown in FIGS. 1 and 2 and 23. Therefore, in the preferred embodiment, body 12 includes a blade head 108 having a first guide cheek 102 and a second guide cheek 104, each of which are angled at a angle alpha 106 relative to the plane of blade 16.

Replaceable Roller

The knife also has the additional feature of a replaceable roller 24. Roller attachment mechanism 25 is shown in FIGS. 12 through 21 inclusively.

Figure 12:
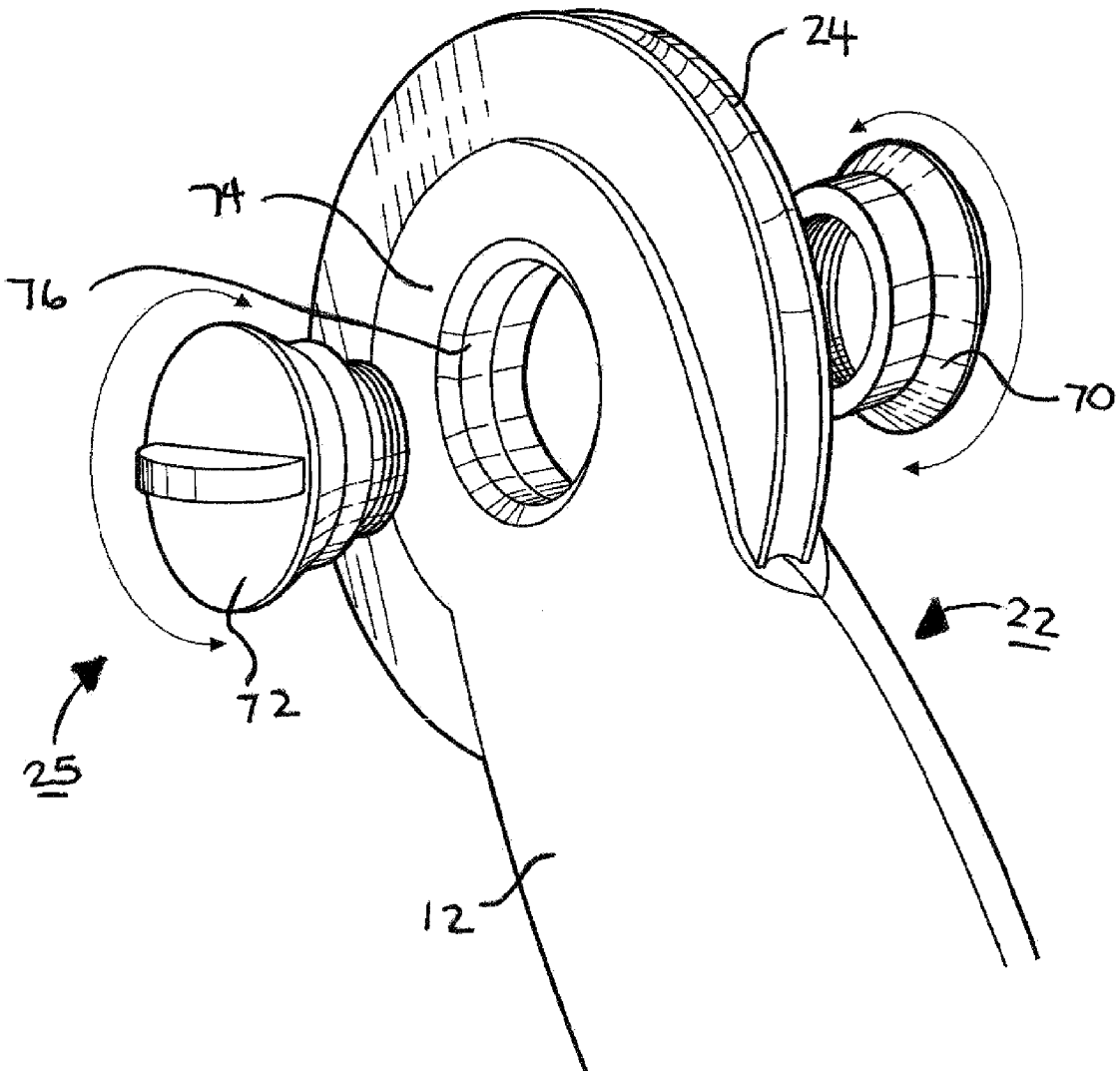
FIG. 12 is an exploded assembly perspective view of the roller end of the knife showing the male roller and the female roller bushings.
Figure 14:
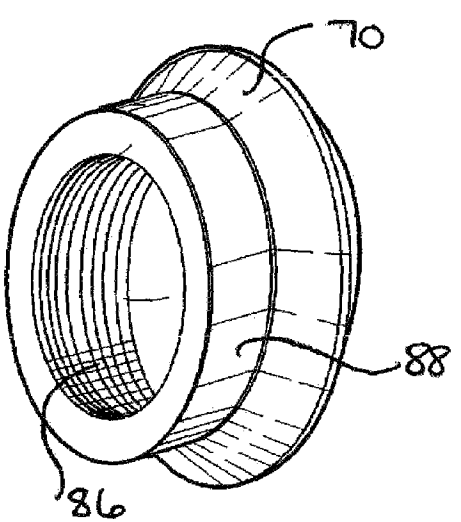
FIG. 14 is a left side perspective view of the female roller bushing.
Figure 13:
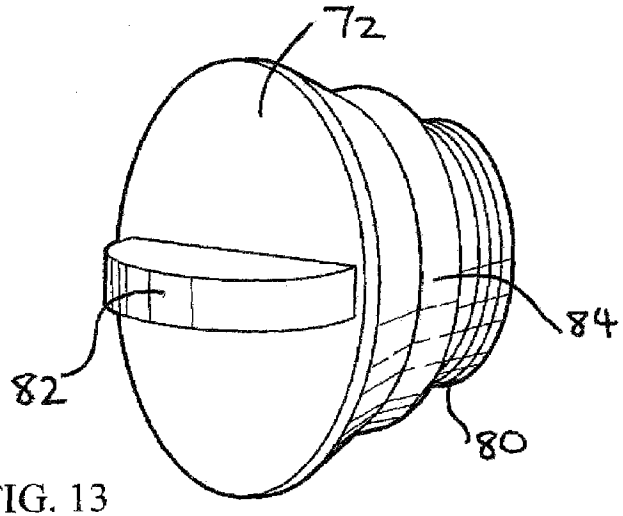
FIG. 13 is a left side perspective view of the male roller bushing.
Figure 16:
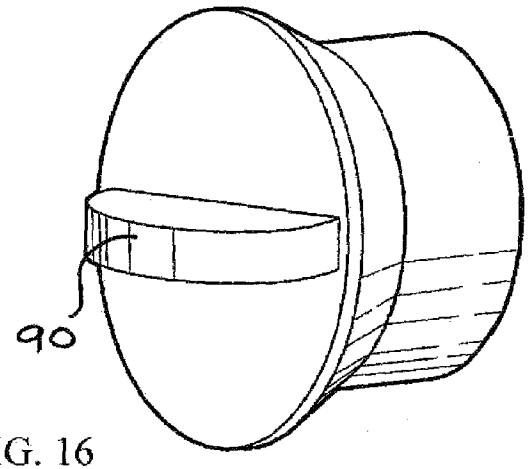
FIG. 16 is a right side perspective view of the female roller bushing.
Figure 15:
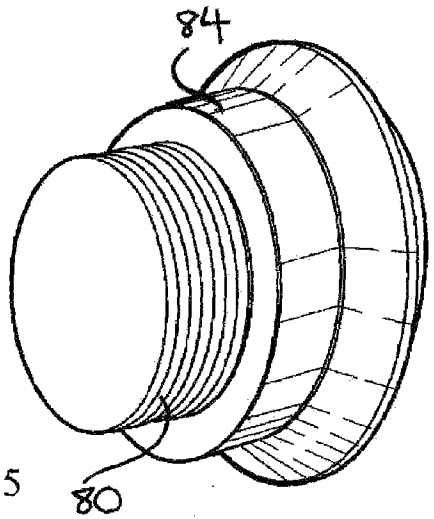
FIG. 15 is a right side perspective view of the male roller bushing.
Figure 17:
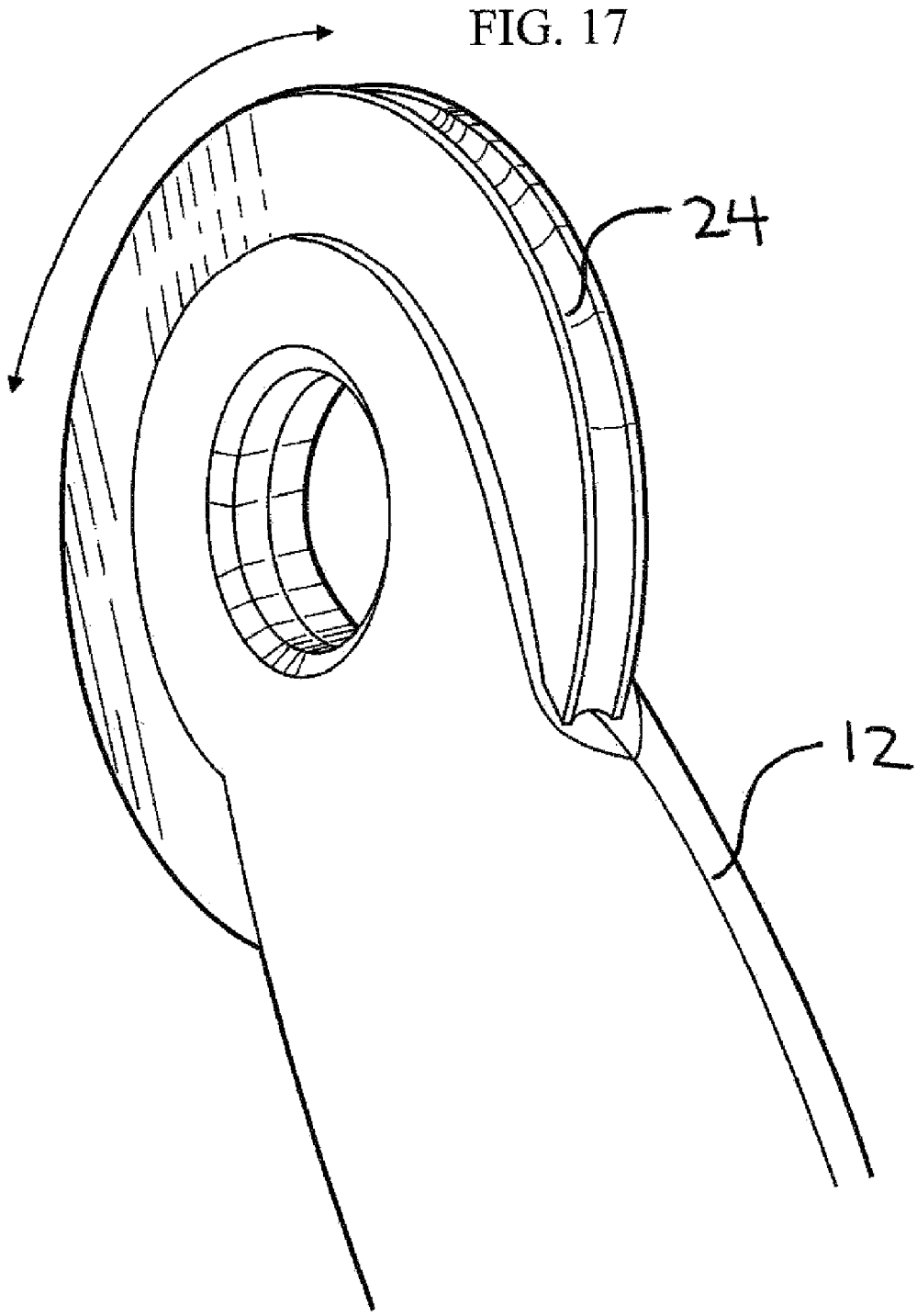
FIG. 17 is a partial perspective view of the roller end of the knife, without the roller bushing.
Figure 24:
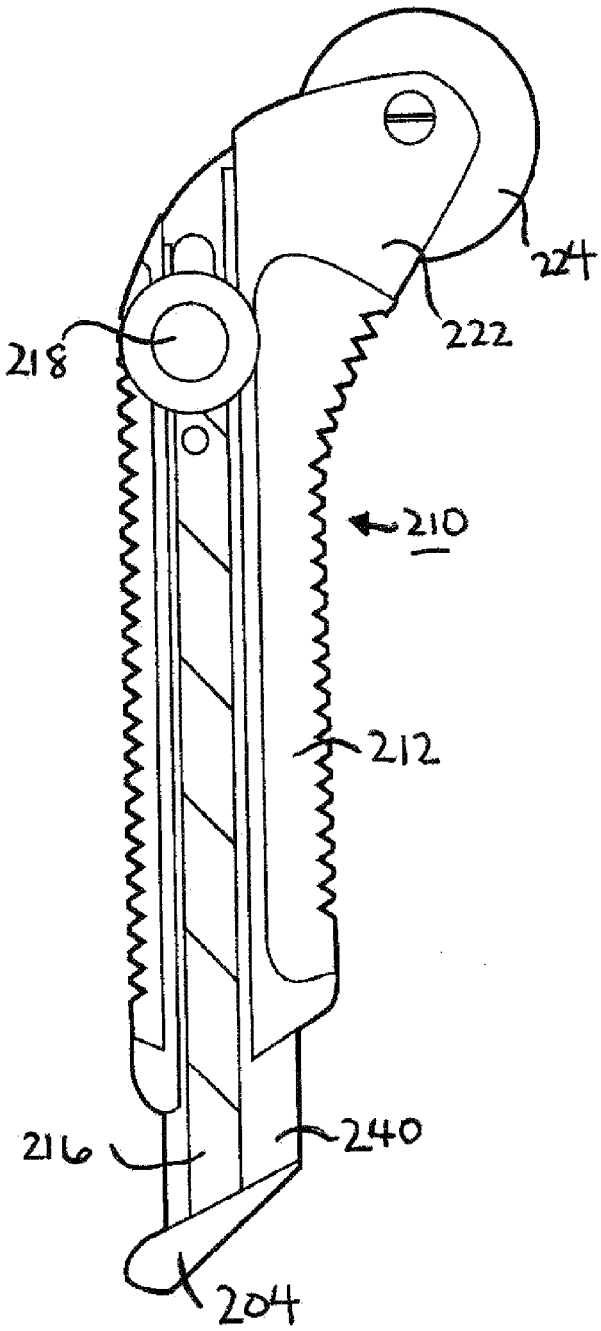
FIG. 24 is a left side elevational view of knife 210.
Figure 25:
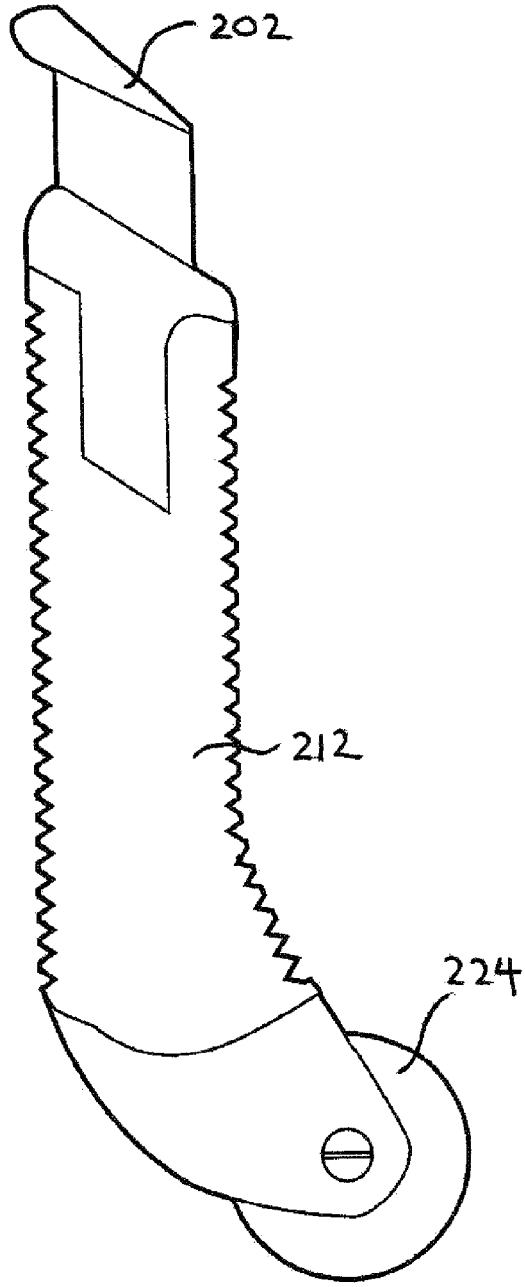
FIG. 25 is a right side elevational view of knife 210.

Looking particularly now to FIG. 12, the components of roller attachment mechanism 25 includes roller 24, male roller bushing 72, female roller bushing 70, roller flanges 74 which are situated on either side of roller 24. Roller 24 further has a roller flange 74 which is a bearing surface upon which the roller turns.

Referring now to FIG. 13 through 16, male roller bushing 72 includes bearing surface 84 and a threaded end 80 and an outer finger grip 82. Female roller bushing 70 includes a bearing surface 88, a threaded aperture 86 and an outer finger grip 90. Threaded end 80 is adapted to mesh end and fit into threaded aperture 86 by applying rotational forces onto finger grips 82 and 90. In this way a roller 24 is mounted onto bearing surfaces 84 and 88, such that roller end or circumference 76 rise or rolls upon bearing surfaces 88 and 84 of the combined male and female roller bushing 70 and 72.

FIGS. 22 through 35 depict an alternate embodiment of the present device, namely utility knife 210, having the following major components, namely body 212 having mounted therein a blade channel 240, having mounted therein a blade 216. Blade channel integrally connected and projecting from blade channel 240 are a first guide cheek 202 and a second guide cheek 204 which are oriented at an angle of approximately 90 degrees relative to each other. Body 212 has a roller end 222 having mounted thereon a roller 224. Roller end 222 is dimensioned to place roller 224 spaced from and below lower most part of body 212. Body blade channel has connected thereto a retract button 218 for slideably moving blade 216 within blade channel 240 and also for locking blade 216 at a preselected position within blade channel 240.

Referring now to FIGS. 26 through 30, roller 224 can take on two positions namely pointed position 258 best show in FIGS. 28 and 29 and groove position 260 as best shown in FIGS. 33 and 34.

Roller 224 preferably is comprised of two halves, namely wheel half 252 and right wheel half 250. Each wheel half has a chamfered surface 280, a large face 256 and a small face 254. By placing large face 256 adjacent to each other as shown in FIG. 28, the wheel halves are placed into a pointed position 258 as shown in FIG. 28 and 29. Roller 224 can now be mounted onto the roller end 222 of utility knife 210 using a screw 272 and a nut 274 as depicted in FIG. 30. Screw 272 is received through hole 270 for rigidly maintaining left wheel half 242 and right wheel half 250 in intimate contact. In pointed position 258, small faces 254 of each wheel half form the external surfaces of roller 224.

Referring more specifically now to FIGS. 31 to 35, roller 224 can be placed into group position 260 by placing small face 254 of each wheel half in intimate contact as shown in FIGS. 33 and 34. In this case, large face 256 of each wheel half, now forms the outer surface, whereas the chamfered surface 280 forms a groove along the outer diameter of roller 224.

In this manner by dismounting roller 224 and splitting left wheel half 252 away from right wheel half 250, one can place roller 224 into either the pointed position 258 and/or the grooved position 260, which ever is preferable for the use at hand.

When one wishes to insert spline into a groove for anchoring screen into a frame, one may wish to place roller 224 into groove position 260 in order to manipulate the spline into a groove.

On the other hand, if one is wishing to crease wall paper, carpet and/or vinyl into a corner, it may be preferable to place roller 224 into pointed position 258 as shown in FIG. 28.

It should be apparent to persons skilled in the arts that various modifications and adaptation of this structure described above are possible without departure from the spirit of the invention the scope of which defined in the appended claim.

I claim:

1. A knife comprising:

(a) a body including a blade head at one end and demountable roller at the other end;

(b) the blade head including a planar first guide cheek and planar second guide cheek, positioned at an angle, alpha relative a blade which is received between the first and second guide cheeks;

(c) a means for urging said blade between a retracted position and an extended position;

(d) further including a means for demountably attaching said roller to a roller end of said knife body;

(e) wherein the roller further including a right wheel half and a left wheel half such that the roller being comprised of two halves in intimate contact with each other;

(f) wherein each wheel half including a planar small face and a planar large face and a chamfered surface;

(p) wherein the wheels being selectively mountable in a pointed position or in a grooved position wherein the wheels in a pointed position the larger faces are mounted in contact with each other and when wheels in a grooved position the small faces are mounted in contact with each other.

2. The knife claimed in claim 1, wherein said attaching means further includes a screw cooperatively fastening with a nut for fastening the roller to a roller inner circumference defined in the roller end of said body of said knife.

* * * * *